US006792772B1

(12) United States Patent
Seiss et al.

(10) Patent No.: US 6,792,772 B1
(45) Date of Patent: Sep. 21, 2004

(54) REFRIGERATED COOLER

(75) Inventors: Richard A. Seiss, Spartanburg, SC (US); Jay E. Eichman, Spartanburg, SC (US); Robert A. Johnson, Spartanburg, SC (US)

(73) Assignee: Carrier Commercial Refrigeration, Inc., Aurora, IL (US)

( * ) Notice: Subject to any disclaimer, the term of this patent is extended or adjusted under 35 U.S.C. 154(b) by 0 days.

(21) Appl. No.: 10/410,556

(22) Filed: Apr. 9, 2003

(51) Int. Cl.[7] ..... F25D 17/08
(52) U.S. Cl. ..... 62/415; 62/418; 454/91
(58) Field of Search ..... 62/413–418, 407, 62/239; 454/90–91

(56) References Cited

U.S. PATENT DOCUMENTS 1,916,165 A * 6/1933 Calton ..... 62/413
1,964,822 A * 7/1934 Klippel ..... 62/97
2,221,927 A * 11/1940 Reilly ..... 454/90
2,256,197 A * 9/1941 Finger ..... 62/418
2,300,640 A * 11/1942 Bonsall ..... 62/245
2,619,803 A * 12/1952 Doering ..... 62/241
3,196,632 A 7/1965 Buffington
3,702,544 A * 11/1972 Grinups ..... 62/414
3,805,544 A * 4/1974 Stromblad ..... 62/413
4,879,877 A * 11/1989 Hicke ..... 62/89
4,972,682 A 11/1990 Smith et al.
5,187,945 A * 2/1993 Dixon ..... 62/234
5,433,082 A 7/1995 Trulaske
6,164,085 A * 12/2000 Clarke et al. ..... 62/408

* cited by examiner

*Primary Examiner*—William E. Tapolcai

(57) ABSTRACT

A forced air cooler (10) includes a cabinet (20) defining a lower chamber (30) wherein product is stored and an upper chamber (40) housing a pair of fans (62) and (64) positioned intermediate spaced evaporators (52) and (54). A wire rack (90) disposed on the floor of the cabinet (20) supports the product off the floor and includes integral side fences (94) and (96) which serve to space the product away from the side walls (26) and (28) of the cabinet. The fans (62) and (64) draw air through the evaporators (52) and (54), respectively, and direct the cooing air through the openings provided by the slots (68) in the diffuser plate (66) to provide a uniformly distributed flow of cooling air, at its coolest condition, downwardly into the lower chamber (30) to pass over the product stored therein. Upon reaching the floor of the lower chamber, the cooling airflow passes along the surface of the floor and is drawn into the lower return air duct (70) and thence into side air ducts (76) and (78) to return to the upper chamber (40) and be again drawn through the evaporators (52) and (54).

9 Claims, 3 Drawing Sheets

REFRIGERATED COOLER

BACKGROUND OF THE INVENTION

The present invention relates generally to refrigerated coolers and more particularly to forced air coolers of type adapted for use in schools as a milk cooler which provides easily access by students to the chilled milk containers stored therein.

Forced air coolers are commonly used in schools to chill milk containers for self-service access. Students passing through the cafeteria line reach in to the cooler through a door opening on one side of the cooler or through either of a pair of door openings provided on opposite sides on the cooler to accommodate two lines of students passing by the cooler. The door/doors when open provide access to the interior of the cooler wherein the milk containers are stored. In conventional forced air coolers, the refrigeration system includes an evaporator/fan system adapted to blow refrigerated air into the uppermost region of the cooler interior across the top of the cooler and collect return air from the bottom region of the cooler.

In U.S. Pat. No. 3,196,632, Buffington discloses a forced air cooler including a cabinet defining a relatively long and relatively low rectangular chamber for chilling containers and having an upper portion of the front wall of the cabinet which is removable to provide access to the chilled product within the chamber. An evaporator and circulating fan are disposed along the back wall of the chamber. Refrigerated air discharges horizontally across the top of the chamber towards the front and the opposite end walls of the chamber and returns, for cooling and recirculation, to a fan inlet which is centrally located at the lower portion of the back wall of the chamber. Thus, the refrigerated air passes outwardly across the top of the chamber, thence downwardly along the front and side walls and back to the fan inlet. In the forced air circulation pattern thus established, the refrigerated air chills the product stacked within the chamber.

In U.S. Pat. No. 4,972,682, Smith et al. disclose a forced air cooler defining a rectangular enclosure having a door in the front wall and top thereof for providing self-service access to individuals, such as for example students passing through a school cafeteria line, to individual service beverage containers, such as milk cartons and the like. A plenum housing an evaporator/fan system is disposed in the uppermost region of the cooler atop the chilled enclosure housing the beverage containers and a condenser/compressor system disposed beneath the floor of and exteriorly of the chilled enclosure. A bottom spacer, typically a wire grid having support legs, is placed atop the floor of the cooler to support the baskets of milk containers off the floor of the cooler such that an air flow gap is provided superadjacent the cooler floor and beneath the milk containers. A wire fence, functioning to space the product away from the front wall, is mounted to the inner surface of the front wall of the cooler by means of brackets and screws. An air return air duct is provided along the back wall of the enclosure with its inlet opening to the lower portion of the enclosure and its outlet to the fan plenum. Refrigerated air discharges horizontally outwardly along the length of the plenum toward the front wall of the enclosure and flows generally downwardly to and down the front wall of the enclosure to the floor thereof, thence along the floor toward the back wall of the enclosure and thence upwardly through the air return duct and to return to the fan plenum.

Although the forced air circulation systems disclosed in Buffington and Smith et al. have proven effective for coolers having self-service access through an access door opening along the upper portion of the front wall and/or top of the cooler, there exists a need for a forced air cooler having access doors opening along both the front and the back of the cooler.

SUMMARY OF THE INVENTION

It is an object of the present invention to provide a forced air cooler wherein self-service access is provided along both the front and the back walls of the cooler. It is a further object of the present invention to provide such a forced air cooler having an improved cooling air circulation system.

The forced air cooler of the present invention includes a cabinet having a front wall, a back wall, first and second longitudinally spaced side walls, a floor panel and a top panel cooperatively defining a lower chamber for housing articles to be cooled and an upper chamber disposed superadjacent said lower chamber. A diffuser plate having a plurality of airflow openings passing therethrough extends generally horizontally between said lower chamber and said upper chamber. At least one evaporator for cooling air passing therethrough is disposed within said upper chamber. At least one air circulator is positioned within the upper chamber in operative association with the at least one evaporator for generating a flow of cooling air passing through the evaporators. A bottom airflow passage lies superadjacent the floor of the lower chamber beneath the articles housed within the lower chamber. The bottom airflow passage is in flow communication with the interior of the lower chamber and with at least one air return duct extending from its inlet adjacent the floor of the chamber to its outlet opening to the upper chamber.

A first side air return duct lies along side first side wall and a second side air return duct lies the said second side wall. Each side air return duct has an inlet opening superadjacent the floor of the lower chamber and an outlet opening into the upper chamber. A lower air return passage lies superadjacent the floor of the lower chamber and extends between the side air return ducts beneath the articles housed within the lower chamber. The bottom airflow passage is in flow communication with the interior of the lower chamber and with the inlet of each of the first and second side air return ducts.

This improved air circulation system produces the very efficient cooling airflow. Cooling air is drawn through the evaporators by the air circulator, such as one or more fans, and is cooled as it traverses the evaporators. The cooling air leaving the evaporators is then driven by the fans through the openings provided in the diffuser plate to provide a uniformly distributed flow of cooling air across the surface of the articles disposed within the lower chamber and downwardly into the lower chamber to pass through the stacked. Upon reaching the floor of the lower chamber, the cooling airflow passes along the surface of the floor and is drawn into the lower air return passage. The airflow then passes from the lower air return passage into the side air return ducts that extend vertically along the respective side walls of the cabinet and passes upwardly therethrough to exit through the from the side air return ducts into the upper chamber and be again drawn through the evaporators.

Advantageously, a rack or grate having a relatively open wire framework base section with integral edge fences may be positioned on the floor of the lower chamber for supporting articles to be cooled, such as for example a plurality of milk carton caddies stacked in columns, one atop another, within the lower chamber and above the floor thereof so as to provide an airflow gap between the upper surface of floor and the articles support on the rack.

BRIEF DESCRIPTION OF THE DRAWINGS

The various features and advantages of this invention will become apparent to those skilled in the art from the following detailed description of the currently preferred embodiment with reference to the accompany drawings wherein.

DETAILED DESCRIPTION OF THE PREFERRED EMBODIMENT

Figure 1:
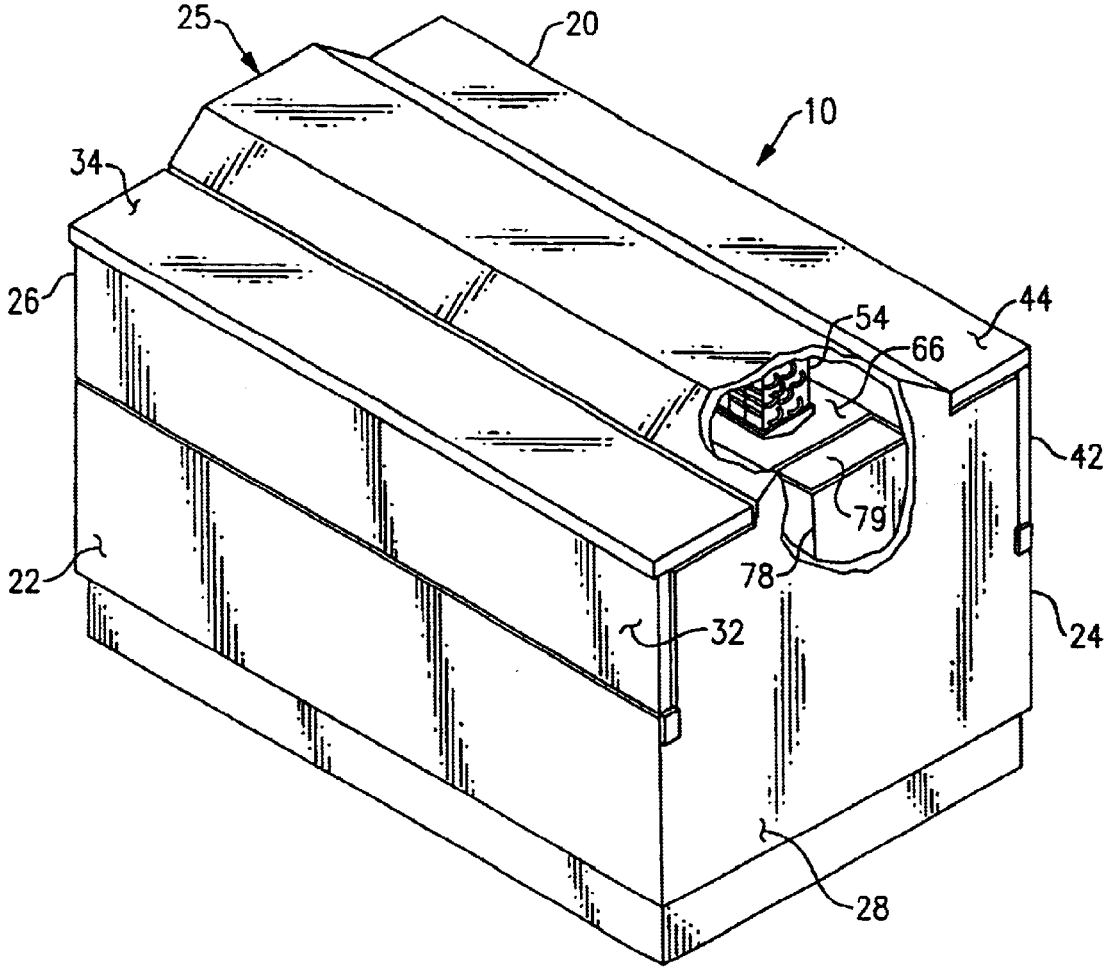
FIG. 1 is a perspective view, partly sectioned, of an embodiment of the forced air cooler of the present invention.

Referring now to the accompanying drawings, the forced air cooler 10 is depicted, for purposes of illustration, as a twin access milk cooler/server for providing ready access from either the front and/or back of the cooler to cartons of milk stored therein by individual passing through a cafeteria line. The presently preferred embodiment of the forced air cooler 10 includes a cooler cabinet 20 defining a lower chamber 30 wherein articles to be maintained in a chilled environment, such as for example cartons of milk disposed in carton caddies 80, are stacked and an upper chamber 40 superadjacent the lower chamber 30. The cabinet 20 includes insulated front wall 22, insulated back wall 24, insulated side walls 26 and 28 disposed at and connecting between opposite ends of the front and back walls, insulated floor panel 23 and insulated top panel 25. The top panel 25 includes an upper section 25*a* extending horizontally between the side walls 26 and 28, a forward section 25*b* extending outwardly and downwardly along the forward edge of the upper section 25*a* between the side walls 26 and 28 at an acute angle to the vertical, and an aft section 25*c* extending outwardly and downwardly along the forward edge of the upper section 25*c* between the side walls 26 and 28 at an acute angle to vertical.

The cabinet 20 has a pair of access openings 35 and 45 provided along the front and back, respectively, of the cabinet 20. Access to the chamber 30 of the cabinet 20 through opening 35 is made available through a double door system comprising a first front panel 32 suitably hinged to the front wall 22 for pivotal movement about a horizontal axis 31 and a second front panel 34 suitably hinged to the frontal edge of the forward section 25*b* of top panel 25 for pivotal movement about a horizontal axis 33. Similarly, access to the chamber 30 of the cabinet 20 through opening 45 is made available through a double door system comprising a first rear panel 42 suitably hinged to the back wall 24 for pivotal movement about a horizontal axis 41 and a second rear panel 44 suitably hinged to the rearward edge of the aft section 25*c* of top panel 25 for pivotal movement about a horizontal axis 43.

Figure 2:
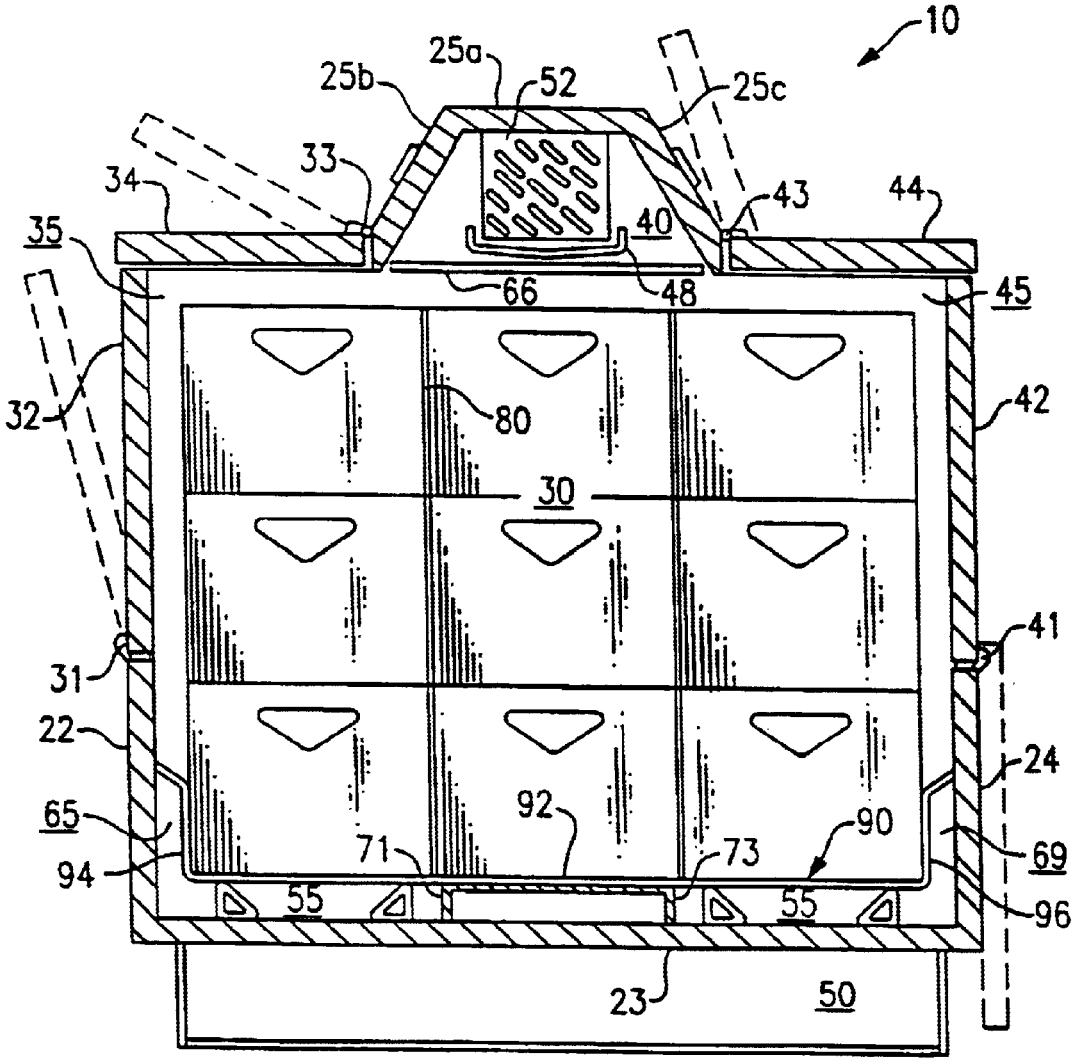
FIG. 2 is a sectional elevation view, taken along line 2—2 of FIG. 1.
Figure 3:
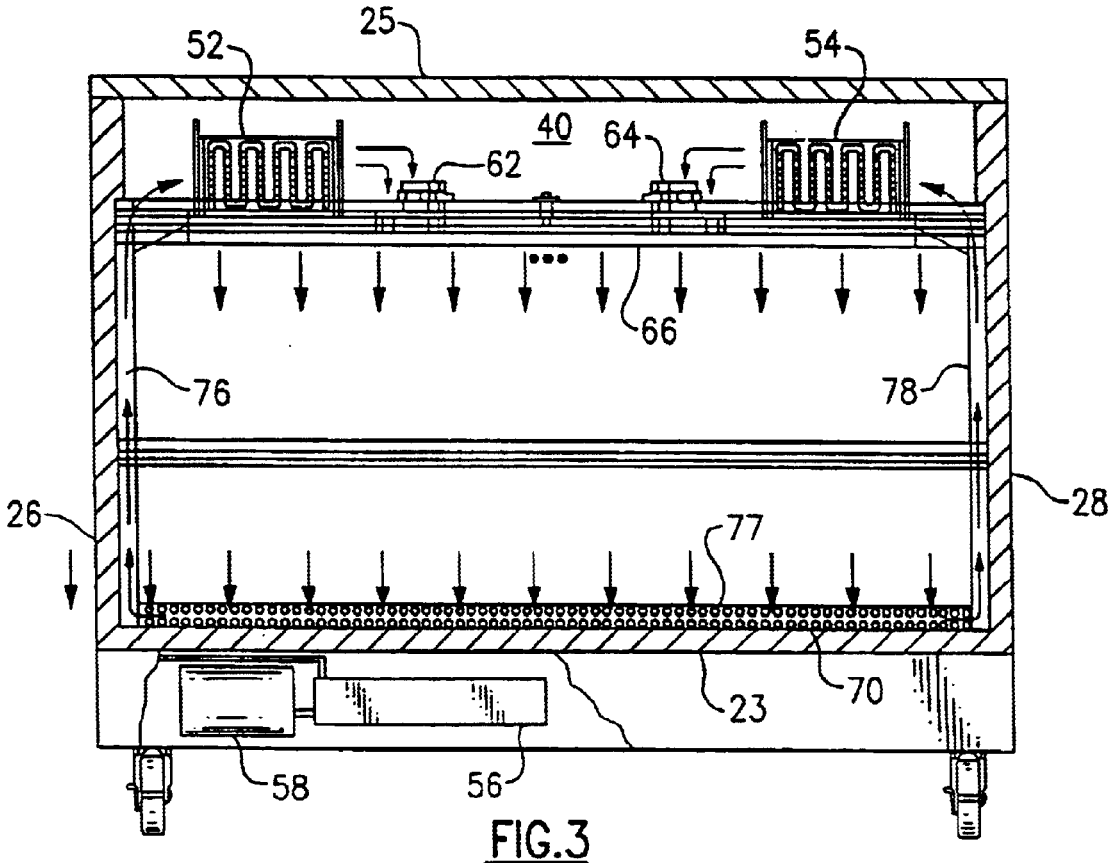
FIG. 3 is a sectional elevation view taken along line 3—3 of FIG. 1.

As best seen in FIGS. 2 and 3, a plurality of milk carton caddies 80 are stacked in columns, one atop another, within the chamber 30 and supported above the floor panel 23 on rack or grate 90 so as to provide a gap 55 between the upper surface of floor panel 23 and the bottoms of the caddies 80. The rack 90 comprises a relatively open, welded wire framework, preferably powder coated with an epoxy or plastic material, having a horizontal base section 92 and vertically extending edge fences 94 and 96 integral with the base section 92 and extending along the front and aft edges, respectively, thereof. The fence 94 extends vertically upwardly from the front edge of the base section 92 against the front wall 22 of the cabinet 20 to space the caddies 80 away the front wall 22 so as to provide a gap 65 between the inner surface of the front wall 22 and the stacked caddies 80. The fence 96 extends vertically upwardly from the aft edge of the base section 92 against the back wall 24 of the cabinet 20 to space the caddies 80 away the back wall 24 so as to provide a gap 69 between the inner surface of the back wall 24 and the stacked caddies 80. The grate 90 merely sits upon the upper surface of the floor panel 23. The fences 94 and 96, being formed integrally with the base section 92 of the grate 90 are not fastened to the respective walls that they abut. Thus, the grate 90 may be quickly removed from the cabinet without tools for easy cleaning of the cabinet interior. As fasteners are not used to mount the fences 94 and 96 to the walls of the cabinet, the interior walls of the cabinet may be more thoroughly cleaned. Further, as no shelves are disposed within the chamber 30, no fasteners are needed to mount and support such shelves from the walls of the cabinet 20.

The forced air cooler 10 is provided with a refrigeration system comprising a pair of evaporators 52 and 54, a condenser 56 and a compressor 58 suitably arranged and connected in the conventional manner in refrigerant flow communication via coolant lines (not shown). The condenser 56 and the compressor 58 are disposed externally of the chamber 30 in a compartment 50 beneath the insulated floor panel 23 to insulate the chamber 30 from the heat developed by the condenser 56 and the compressor 58. The evaporators 52 and 54, which may comprise conventional fin and tube heat exchangers, are disposed in spaced relationship at opposite ends of the upper chamber 40 that lies superadjacent the chamber 30 within the region defined by the upper section 25*a* and forward and aft sections 25*b* and 25*c* of the top panel 25. A drip pan 48 extends beneath each of the evaporators 52 and 54 to catch any condensate that may drip off the evaporators. Coolant lines (not shown) extend along the side walls 26 and 28 to interconnect the evaporators 52 and 54 in coolant flow communication in the conventional manner with the condenser and the compressor.

Figure 4:
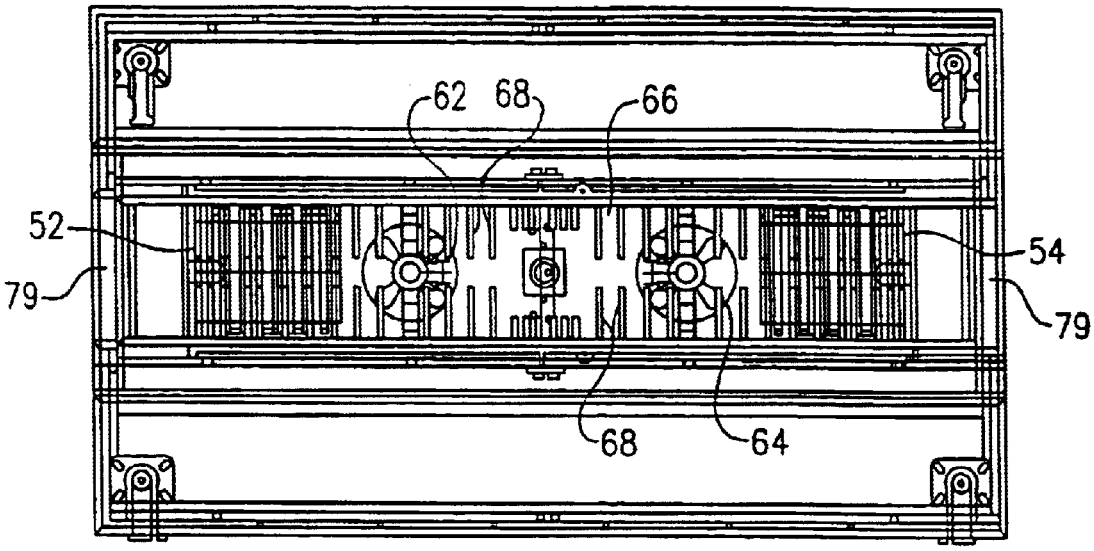
FIG. 4 is a sectional plan view taken along line 4—4 of FIG. 3.

The forced air cooler 10 further includes a cooling air circulation system having at least one air circulator disposed between the spaced evaporators 52 and 54, a diffuser plate 66, lower air return duct 70 and side air return ducts 76 and 78. Most advantageously, the air circulator 60 comprises two or more axial flow fans 62 and 64, disposed at spaced intervals within and along the length of the upper chamber 42 between the evaporators 52 and 54. As best seen in FIGS. 3 and 4, the fans 62 and 64 are suitably supported within the upper chamber 40 with the diffuser plate 66 extending longitudinally beneath the fans between the upper chamber 40 and the lower chamber 30. The diffuser plate 66 has a plurality of openings 68 therethrough that are distributed along the length of the diffuser plate 66 and serve to provide passages through which the cool air having passed through either of the evaporators 52 and 54 is conveyed by fans 62 and 64 distributed across substantially the entire expanse of the lower chamber 30 and over the surface of the articles housed therein. In the preferred embodiment as illustrated in FIG. 3, the openings comprise longitudinally spaced slots 68 that extend generally transversely to the longitudinally extending diffuser plate 66. It is to be understood, however, that the openings 68 in the diffuser plate 66 may comprise holes of any shape distributed over the surface of the diffuser plate in any desirable pattern without departing from the spirit and scope of the present invention.

The lower air return duct 70 lies on the surface of the floor 23 of the lower chamber 30 generally equally spaced from the front and back walls of the lower chamber 30 and extends along the longitudinal length of the lower chamber 30 from one sidewall to the other side wall. The lower air return duct 70 comprises a sheet metal member having an upper base plate and side flanges 71 and 73 extending downwardly to the floor 23 of the lower chamber 30 to define a bottom return airflow passage 75 having an air outlet at each end thereof. The flanges 71 and 73 are perforated with a plurality of holes 77 along substantially the entire length of the flanges. Side air return ducts 76 and 78 extend upwardly along the left and right side walls 26 and 28, respectively, from their respective air inlets superadjacent the floor 23 of the chamber 30 to their respective air outlets 79 opening into the upper chamber 40 at the opposite ends thereof. The air inlets of the side air return ducts 76 and 78 mate with the air outlets at the respective longitudinally spaced ends of the lower air return duct 70 to receive airflow therefrom.

This air circulation system produces the very efficient cooling airflow illustrated in FIG. 3 by the line of arrows. The fans 62 and 64 draw air through the evaporators 52 and 54, respectively. As the airflow traverses the evaporators, it is cooled as it passes over the finned tubes through which coolant is passing. The cooling air leaving the evaporators is then driven by the fans through the openings provided by the slots 68 in the diffuser plate 66 to provide a uniformly distributed flow of cooling air across the surface of the articles disposed within the lower chamber 30 and downwardly into the lower chamber 30 to pass over the articles stored therein. Upon reaching the floor 23 of the lower chamber 30, the cooling airflow passes along the surface of the floor 23 and is drawn to the lower air return duct 70 through the holes 77 in the side flanges 71 and 73 thereof into the bottom airflow passage 70. The airflow then passes from the bottom airflow passage 75 via the outlets of the lower air return duct 70 through the respective inlets into the side air ducts 76 and 78 that extend vertically along side walls 26 and 28, respectively, and passes upwardly therethrough to exit through the outlets 79 to return to the upper chamber 40 and be again drawn through the evaporators 52 and 54.

With this air circulation system, the coolest airflow is introduced into the lower chamber 30 uniformly across and above the product stored therein to flow downwardly over and amongst the product, not only being driven by the fans 62 and 64, but also with the aid of gravity. Additionally, a portion of the coolest cooling air will flow downwardly across the openings 35 and 45 so as to establish an air curtain that isolates the product within the lower chamber 30 from the ambient temperature in external environment. Further, after having lost its coolest condition as it traverses the product, the cooling air reaches the bottom of the chamber 30 and flows through the gap 55 extending beneath the product along the surface of the floor 23 to and through the holes 75 in the side flanges 71 and of the lower air return duct 70, rather then passing back over the product, thereby avoiding possible rewarming of the product. Still further, the return cooling air, being at its least cool condition, passes through the lower air return duct 70 into and upwardly through the side air ducts 76 and 78 wherein it is isolated from the articles 80 stored within the lower chamber 30. Additionally, as the articles stored within the lower chamber 30 are spaced from the front and back walls 22 and 24 by the fences 94 and 96, cooling air may pass downwardly through gaps 65 and 67 along the walls 22 and 24, respectively, thereby ensuring that all product is surrounded by cooling air. In this manner, very efficient and effective cooling of the product is ensured even when the openings 35 and 45 are open for access to the product stored within the forced air cooler 10 of the present invention.

The aforementioned description is meant to be exemplary rather than limiting. Many modifications and variations of the present invention as described may be recognized by those skilled in the art in light of the above teachings that will fall within the spirit and scope of the present invention. The preferred embodiments of this invention have been disclosed. Accordingly, within the scope of the appended claims, the invention may be practiced otherwise than as specifically described. For this reason the following claims should be studied to determine the true scope and content of this invention.

What is claimed is:

1. A cooler comprising:

a cabinet having a front wall, a back wall, first and second longitudinally spaced side walls, a insulated floor panel and a insulated top panel cooperatively defining a lower chamber for housing articles to be cooled and an upper chamber disposed superadjacent said lower chamber;

a generally horizontally disposed diffuser plate positioned between said lower chamber and said upper chamber, said diffuser plate having a plurality of openings passing therethrough;

at least one evaporator for cooling air passing therethrough, said at least one evaporator disposed within said upper chamber;

at least one air circulator disposed within said upper chamber in operative association with said at least one evaporator for generating a flow of cooling air passing through said at least one evaporator;

first and second generally vertically extending air return ducts, each having an inlet opening superadjacent said floor and an outlet opening into said upper chamber, said first air return duct lying along side first side wall and said second air return duct lying along said second side wall;

a lower return air duct defining a bottom airflow passage lying superadjacent said floor and extending beneath the articles housed within said lower chamber, said lower air return duct having a generally horizontal, longitudinally extending base disposed in spaced relationship with and above said floor of said chamber, said bottom airflow passage in flow communication with each of said air return duct, and a first doored self-service access opening into said lower chamber from the front side of said cooler and a second doored self service access opening into said lower chamber from the back side of said cooler.

2. A cooler as recited in claim 1 wherein said at least one evaporator comprises a pair of evaporators disposed within said upper chamber in longitudinally spaced relationship at opposite ends of said upper chamber and said at least one air circulator is disposed between said longitudinally spaced evaporators.

3. A cooler as recited in claim 2 wherein said at least one air circulator comprises an axial flow fan.

4. A cooler as recited in claim 2 wherein said at least one air circulator comprises a pair of longitudinally spaced axial flow fans.

5. A cooler as recited in claim 1 wherein the plurality of openings passing through the diffuser plate comprise a plurality of longitudinally spaced, traversely extending slots.

6. A cooler as recited in claim 1 further comprising a support grate positioned superadjacent said floor, said grate supporting the articles housed within said lower chamber above said floor and establishing the bottom airflow passage.

7. A cooler as recited in claim 6 wherein said support grate comprises a horizontally extending wire framework base, a front fence extending generally vertically upwardly from a front edge of the base and an aft fence extending generally vertically from a back edge of the base, said wire framework base being relatively open to airflow therethrough.

8. A cooler comprising a cabinet having a front wall, a back wall, first and second longitudinally spaced side walls, a insulated floor panel and a insulated top panel cooperatively defining a lower chamber for housing articles to be cooled and an upper chamber disposed superadjacent said lower chamber;

a generally horizontally disposed diffuser plate positioned between said lower chamber and said upper chamber, said diffuser plate having a plurality of openings passing therethrough;

at least one evaporator for cooling air passing therethrough, said at least one evaporator disposed within said upper chamber;

at least one air circulator disposed within said upper chamber in operative association with said at least one evaporator for generating a flow of cooling air passing through said at least one evaporator;

at least one generally vertically extending air return duct having an inlet opening superadjacent said floor and an outlet opening into said upper chamber; and a lower air return duct defining a bottom airflow passage lying superadjacent said floor and extending beneath the articles housed within said lower chamber, said lower air return duct having a generally horizontal, longitudinally extending base disposed in spaced relationship with and above said floor of said chamber and at least one side flange extending generally vertically downwardly therefrom to said floor of said chamber, said at least one side flange being perforated with a plurality of holes in flow communication with said at least one air return duct.

9. A cooler for storing cartons of drink in a chilled state for customer self service comprising a cabinet having a front wall, a back wall, first and second longitudinally spaced side walls, a insulated floor panel and a insulated top panel cooperatively defining a lower chamber for housing articles to be cooled and an upper chamber disposed superadjacent said lower chamber;

a generally horizontally disposed diffuser plate positioned between said lower chamber and said upper chamber, said diffuser plate having a plurality of openings passing therethrough;

at least one evaporator for cooling air passing therethrough, said at least one evaporator disposed within said upper chamber;

at least one air circulator disposed within said upper chamber in operative association with said at least one evaporator for generating a flow of cooling air passing through said at least one evaporator;

at least one generally vertically extending air return duct having an inlet opening superadjacent said floor and an outlet opening into said upper chamber; and a lower air return duct defining a bottom airflow passage lying superadjacent said floor and extending beneath the articles housed within said lower chamber, said lower air return duct having a generally horizontal, longitudinally extending base disposed in spaced relationship with and above said floor of said chamber and at least one side flange extending generally vertically downwardly therefrom to said floor of said chamber, said at least one side flange being perforated with a plurality of holes in flow communication with said at least one air return duct.

* * * * *